US005862615A

United States Patent [19]

O'Rourke

[11] Patent Number: 5,862,615

[45] Date of Patent: Jan. 26, 1999

[54] DISPLAY BUTTON FOR SHOWING FEELINGS

[76] Inventor: Robert H. O'Rourke, 3141 Meirs Rd., Cream Ridge, N.J. 08514

[21] Appl. No.: 757,925

[22] Filed: Nov. 27, 1996

Related U.S. Application Data

[63] Continuation-in-part of Ser. No. 653,407, May 24, 1996, abandoned.

[51] Int. Cl.[6] ..... A44C 3/00

[52] U.S. Cl. ..... 40/1.6; 40/315; 40/421; 446/139; 446/339

[58] Field of Search ..... 40/1.5, 1.6, 315, 40/416, 421; 446/134, 135, 139, 337, 339

[56] References Cited

U.S. PATENT DOCUMENTS

| | | | |
|---|---|---|---|
| 2,336,184 | 12/1943 | Mitchel | 40/1.5 |
| 3,193,969 | 7/1965 | Rosenfeld | 40/416 X |
| 3,210,884 | 10/1965 | Sharff et al. | 446/139 X |
| 3,660,926 | 5/1972 | Lerner et al. | 446/139 X |
| 3,839,821 | 10/1974 | Forsman | 40/1.5 X |
| 4,294,036 | 10/1981 | Wion | 446/135 |
| 4,597,206 | 7/1986 | Benson | 40/1.6 X |
| 4,698,927 | 10/1987 | Yoshiro | 40/1.6 |
| 4,762,494 | 8/1988 | Woods | 446/100 X |
| 4,798,556 | 1/1989 | Vicars et al. | 446/391 |
| 5,215,493 | 6/1993 | Zgrodek et al. | 446/372 |
| 5,235,824 | 8/1993 | Huang | 446/337 X |

FOREIGN PATENT DOCUMENTS

| | | | |
|---|---|---|---|
| 2533452 | 3/1984 | France | 446/100 |
| 2646267 | 10/1990 | France | 40/1.5 |
| 862447 | 3/1961 | United Kingdom | 446/134 |

*Primary Examiner*—Kenneth J. Dorner
*Assistant Examiner*—Andrea Chop
*Attorney, Agent, or Firm*—Ira M. Adler, Esq.

[57] ABSTRACT

A display button worn for adjustably changing human facial expressions from "happy", to "confused", to "sad", to "skeptical", to "scheming to get even", and to "mad". The invention employs a housing having a shell on which are rotatably mounted a pair of rectangular members and an arcuate member, to simulate the eyebrows and mouth of the face, respectively. The facial expression is thereby changed manually by the wearer. Magnets may be used to control the position of the members.

8 Claims, 9 Drawing Sheets

DISPLAY BUTTON FOR SHOWING FEELINGS

This application is a continuation-in-part of application Ser. No. 08/653,407, filed May 24, 1996, now abandoned.

FIELD OF THE INVENTION

The present invention relates to a display button and, more particularly, to one which allows the wearer to express his (or her) feelings in an obvious way for everyone to see.

BACKGROUND OF THE INVENTION

As is well known and understood, most people resent having to stand an inordinate amount of time on line. As is also well known and understood, many other occasions arise where people resent being mistreated and/or taken for granted. For example, people waiting in line at banks, restaurants, theaters, sporting events, etc. oftentimes become disgruntled wondering why it takes so long to be served, to then only reach the front of the line and being told that there will be a further wait or—much worse—that equipment has broken down, and the line is being closed. Similarly, at Town Hall Meetings, PTA Meetings—and public gatherings, in general, it is not unusual to find those in attendance becoming frustrated and angry at positions taken by the speakers for statements being made. In such latter situations, it is not unusual to find law-enforcement authorities on the scene to remove those members of the audience who voice their objections from the floor (without first being recognized to speak), or who just verbally make their feelings known to the speakers.

OBJECTS OF THE INVENTION

It is an object of the present invention, therefore, to provide an alternate manner of allowing such people to express their feelings in an obvious way for all to see.

It is another object of the invention to provide a way for people to "strike-back", or cast an instant vote in order to let others know what they think of what is ongoing, in a non-verbal manner, so as to reduce the possibility of being forcibly ejected when making their feelings known.

It is yet another object of the invention to convey these feelings by means of a display button, nominally in the configuration of a "face", whose expression can be changed at will by the wearer.

It is an additional object of the invention to provide a display button which adjustably allows for changing facial expressions from "happy", to "confused", to "sad", to "skeptical", to "scheming to get even", and to "mad".

SUMMARY OF THE INVENTION

As will become clear from the following description, a display button according to the invention employs a housing having a shell on which are rotatably mounted a pair of rectangular members and an arcuate member, to simulate the eyebrows and mouth of the face, respectively. As will be seen from the following description, the facial expressions displayed can be changed manually. In the preferred embodiment to be described, the eyes and nose will be seen to be displayed directly on the front of the shell.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE DRAWINGS

Figure 1A:
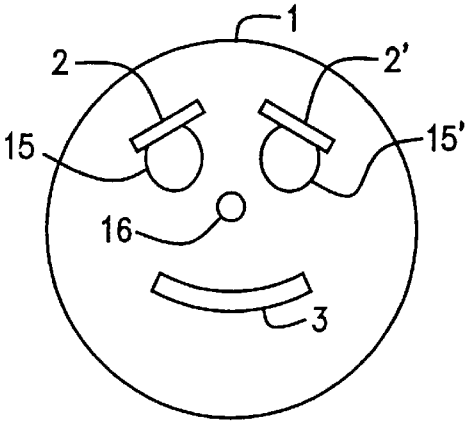
FIGS. 1*a*–1*f*, respectively, show the six facial expressions on a display button for showing feelings, to wit: happy, confused, sad, skeptical, scheming, and mad constructed in accordance with the teachings of the invention, with a pair of simulated eyes and a simulated nose affixed to the shell.

Referring to the drawings, FIGS. 1*a*–1*f* illustrate the display button of the invention along with a pair of generally circular areas, 15 and 15', representative of the "eyes" of a displayed face, and with a substantially circular area, 16, representative of a "nose". A pair of rectangular members, 2 and 2', are shown as representative of the "eyebrows", while a generally arcuate member, 3, representative of the "mouth", are each independently adjustable by a wearer, and in the manner shown in FIGS. 1*a*–1*f*. Said adjustments are made manually by the wearer.

While a preferred embodiment of the invention consists of a basic face, which is typically human, but may be animal or otherwise, with movable eyebrows and mouth, in other variations accessories are attached to the invention to change its appearance. FIGS. 2*a*–2*f*, shows the invention with typical accessories, a small mustache, 50, partial hair, 51, mustache, 52, "VanDyke" beard, 53, full hair, 54, or bow tie, 55, respectively.

Figure 1B:
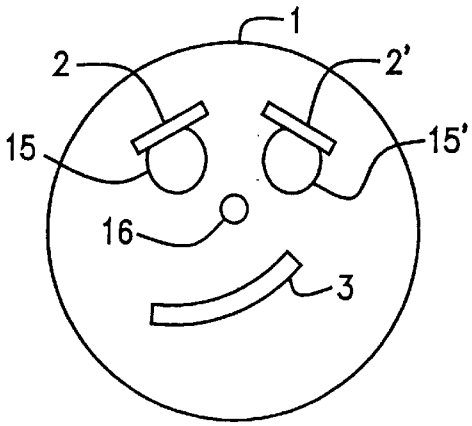
Figure 1C:
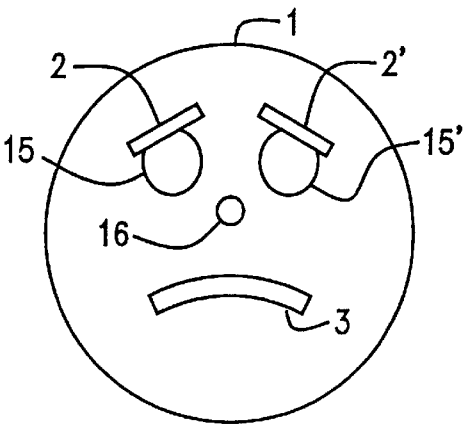
Figure 1D:
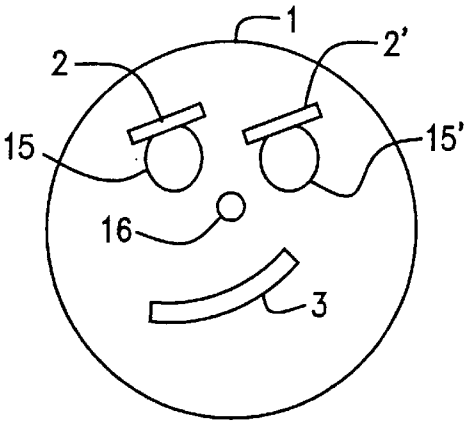
Figure 1E:
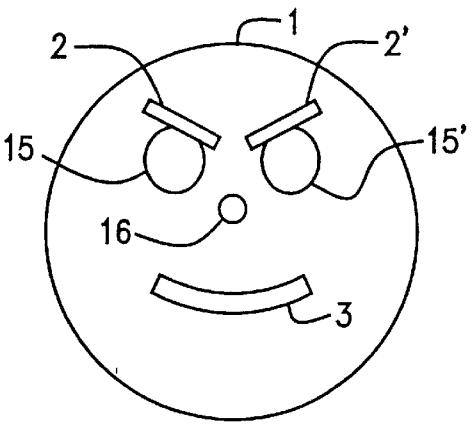
Figure 1F:
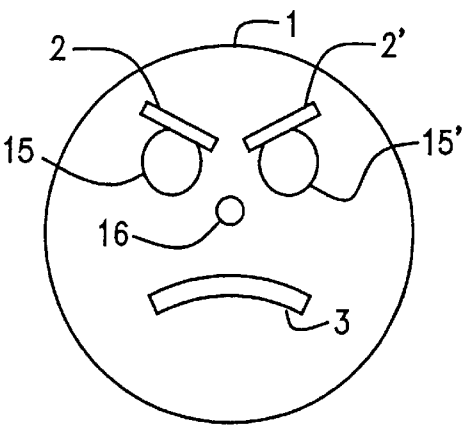
Figure 2A:
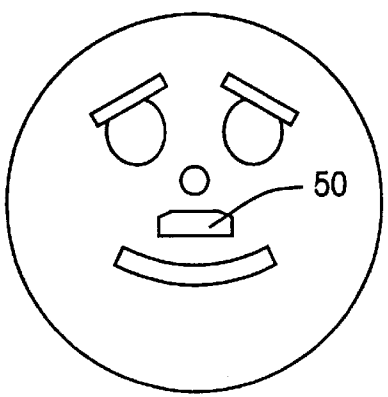
FIG. 2*a* is a front view showing a variation to the invention, to wit: a small mustache.
Figure 2B:
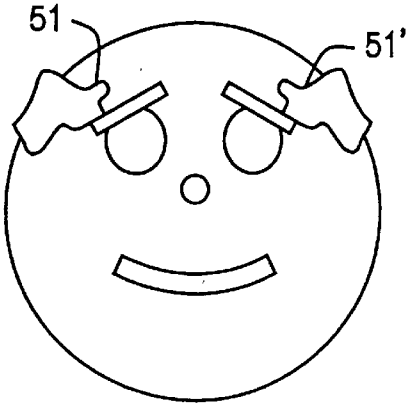
FIG. 2*b* is a front view showing a variation to the invention, to wit: partial hair.
Figure 2C:
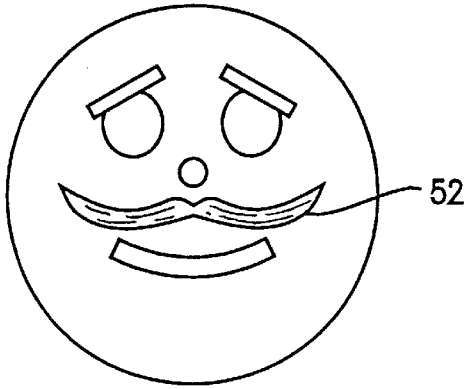
FIG. 2*c* is a front view showing a variation to the invention, to wit: mustache.
Figure 2D:
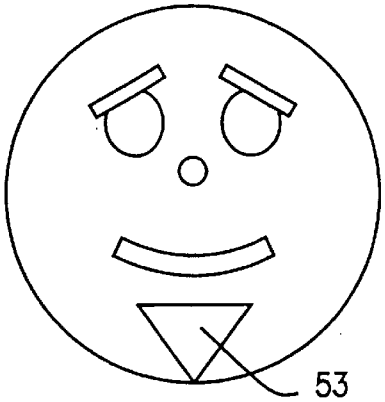
FIG. 2*d* is a front view showing a variation to the invention, to wit: "VanDyke" beard.
Figure 2E:
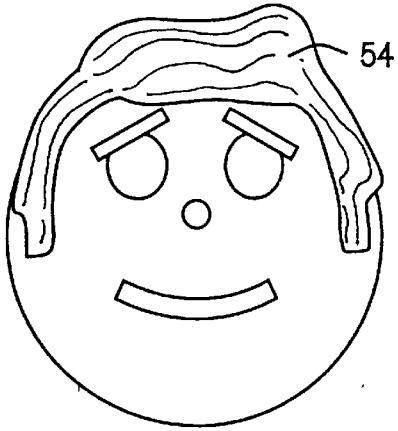
FIG. 2*e* is a front view showing a variation to the invention, to wit: full hair.
Figure 2F:
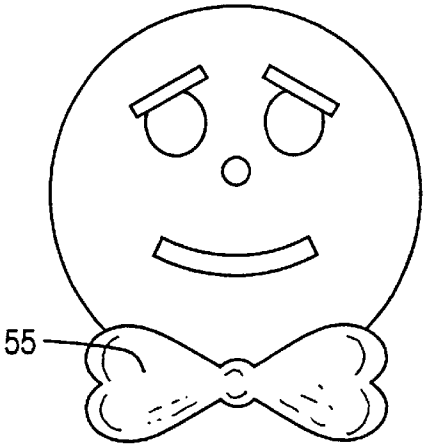
FIG. 2*f* is a front view showing a variation to the invention, to wit: bow tie.

As will be seen from the description that follows, and is seen in FIGS. 1*a*–1*f*, the eye-brow members, 2 and 2', and the mouth member, 3, are each rotatable about a first axis. As will be appreciated by those skilled in the art, FIG. 1*a* depicts the facial expression showing "happiness", while FIG. 1*b* shows the facial expression of "confusion". In like manner, FIG. 1*c* represents the facial expression of "sadness", while that of FIG. 1*d* illustrates the facial expression for one "skepticism". FIG. 1*e* shows the facial expression of "scheming", finally, FIG. 1*f* shows the facial expression of "madness." Any one of the expressions of FIG. 1*a*–1*f* will be understood to be attainable through an adjustable rotation of the rectangular members 2 and 2' and the arcuate member 3 depending upon the then preference of the wearer of the display button. The circular "eye" and "nose" areas, 15 and 15', and 16, respectively, of the display button may be printed directly onto the shell, 1, in completing the presentation and the display of facial expressions.

Figure 3:
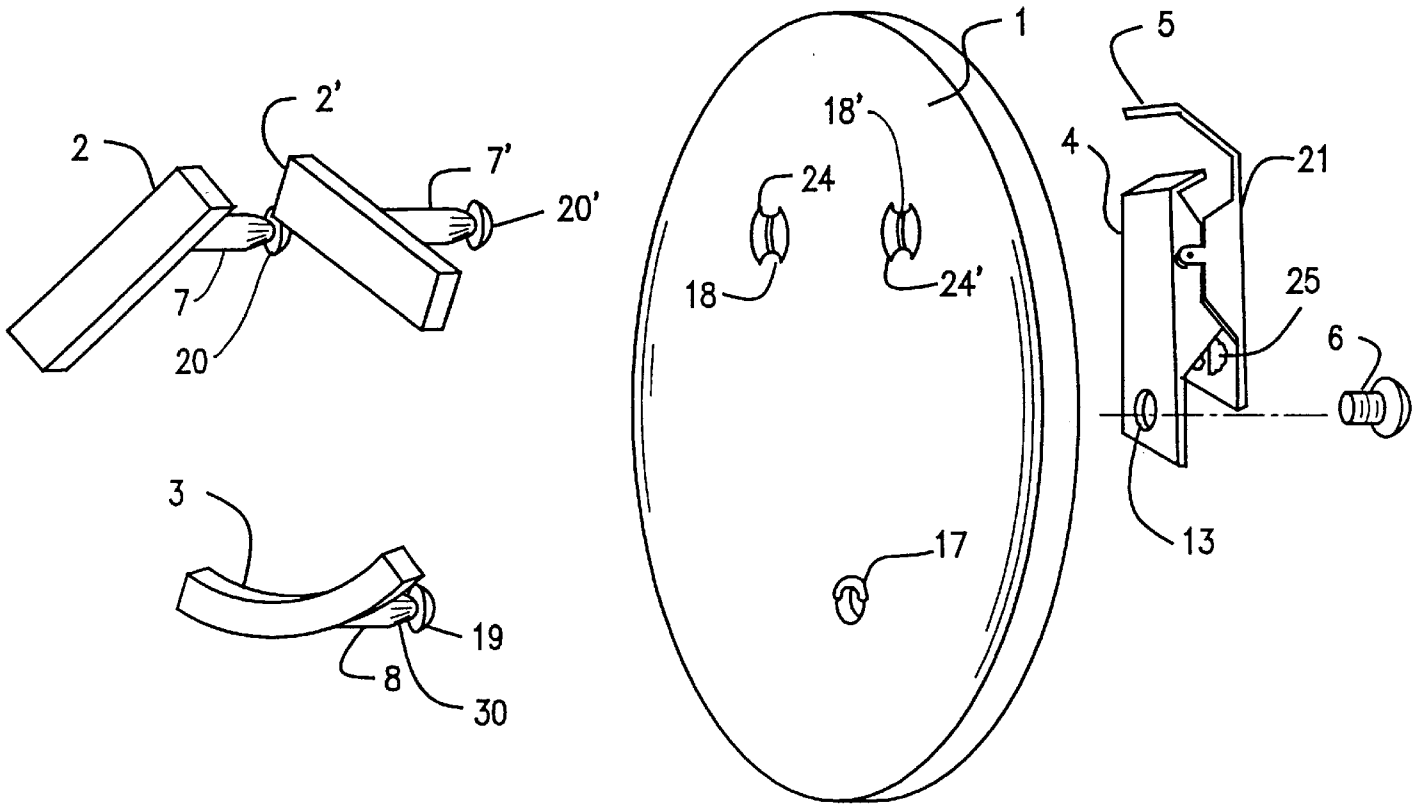
FIG. 3 is a front break-away perspective view of a housing constructed in accordance with the description of the invention.

FIG. 3, shows a front exploded view of the invention. The circular shell, 1, is approximately convex on the front side, but can be flat, with a concave hollow back surface, which also can be flat. A pair of holes, 18 and 18', respectively, are located at approximately at the location human eyes would be on a human face. A hole, 17, is located approximately at the place a human mouth would be located on a human face.

Figure 4:
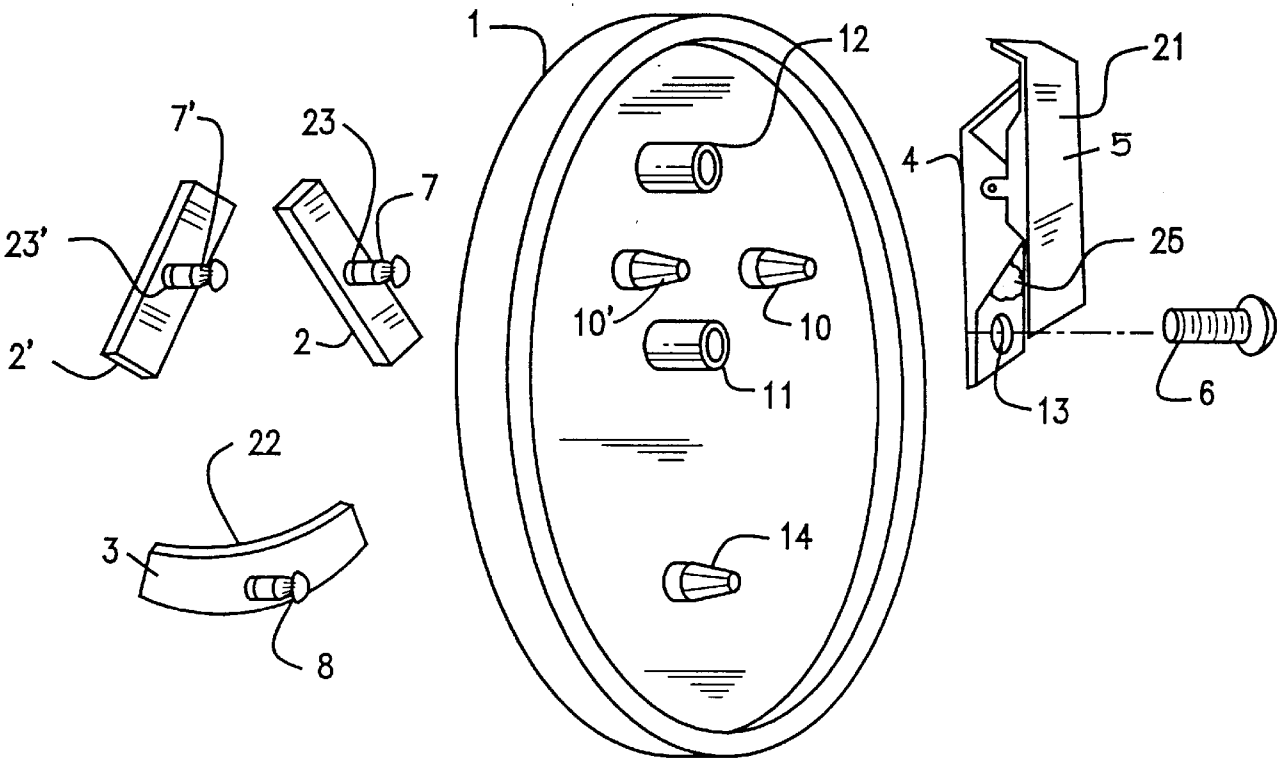
FIG. 4 is a rear break-away perspective view of a housing constructed in accordance with the description of the invention.
Figure 9:
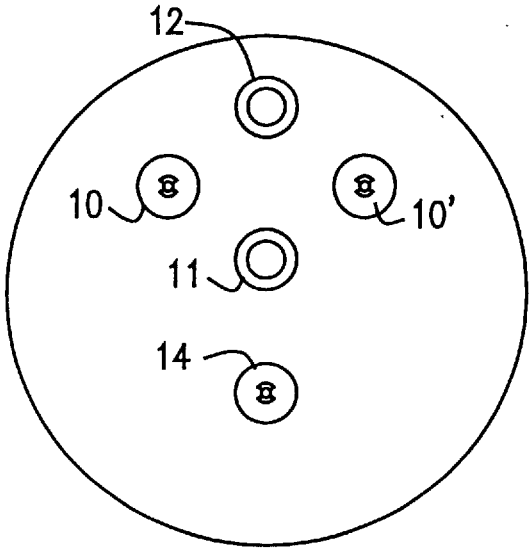
FIG. 9 is a rear view of the invention showing the collets for the eyebrows and mouth in the shell.
Figure 10:
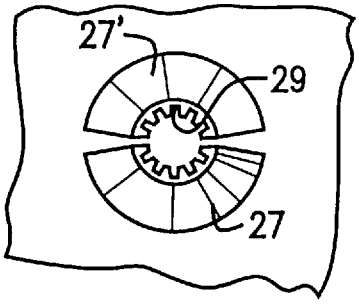
FIG. 10 is a rear detailed view of the collets.

As seen in FIG. 3, a shaft, 8, having a knob, 19, at its end to impede removal, is affixed perpendicularly to the back side of the simulative mouth. A plurality of grooves, 30, run lengthwise on the outside of the shaft. In assembly, the shaft, 8, is inserted into the mouth hole, 17, such that it can not easily be pulled out of the hole, but can rotate 180°. As seen in FIG. 4, the serrated jaws of a collet, 14, on the rear side of the shell, snap against the grooved shaft and limit rotation. The collet is shown in FIGS. 9 and 10. As seen in FIG. 10, the collet consists of two (2) nearly half cones, 27 and 27', which can snap against the shaft, when the shaft is inserted. Serrated jaws, 29, are seen in FIG. 10.

Figure 6:
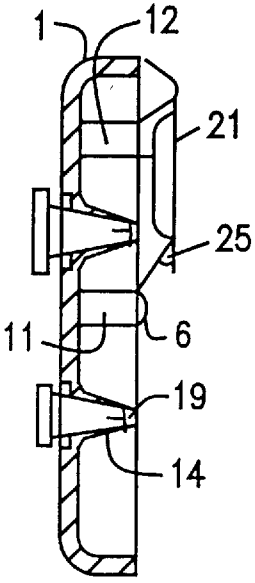
Figure 8:
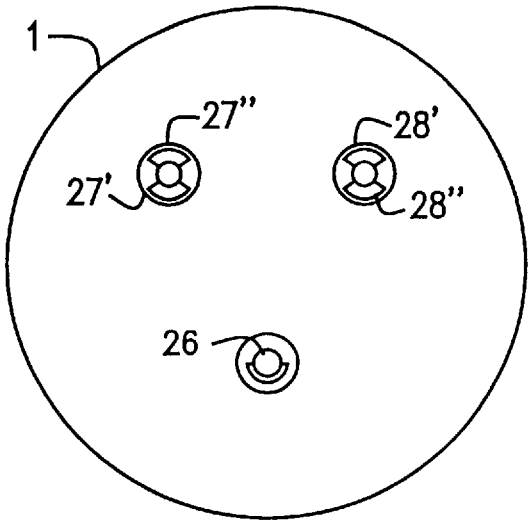
FIG. 8 is a front view of the invention showing a detailed view of the limiting slots for the eyebrows and mouth in the shell.
Figure 11:
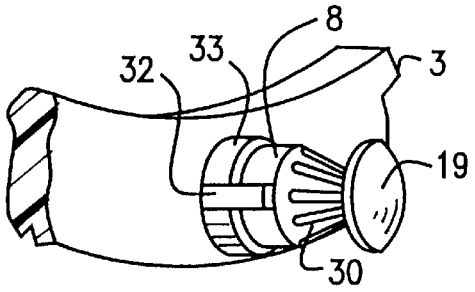
FIG. 11 is a partial perspective view of the mouth and attached shaft.

FIG. 11, a prospective of the simulative mouth, shows a detail of the shaft, 8, which when inserted in the mouth hole, 26, as in FIG. 8, the knob, 19, which spreads the walls, 27 and 27', as in FIG. 10, for insertion. As seen in FIG. 6, the knob, 19, keeps the shaft from being removed. As seen in FIG. 8, a substantially semicircular channel, 26, is partially cut through the face at the location of the mouth hole, A tab, 32, extending from a ridge, 33, as in FIG. 11, on the side of the shaft limits rotation of the mouth to 180° in the semicircular channel, 26.

Figure 12A:
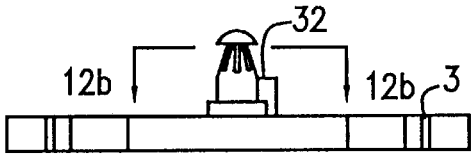
FIG. 12*a* is a side elevation of the mouth.
Figure 12B:
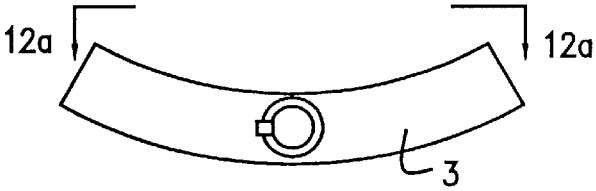
FIG. 12*b* is a top view of the mouth.
Figure 12C:
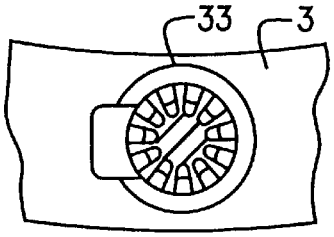
FIG. 12*c* is detailed top section view of the mouth inserted in the collet and a cross section of mouth shaft, showing grooves on the mouth shaft.

In an embodiment of the invention, as seen in FIG. 11, the ribs, 30, cause the shaft to lock in a fixed position by aligning with slits, 29, in the collet. FIGS. 12*a*–12*c* show alternative views of the simulative mouth. A circular collar, 33, surrounds the shaft at its base for support, as seen in FIG. 12*c*.

Figure 13A:
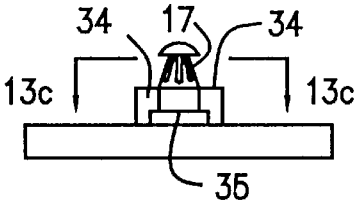
FIG. 13*a* is side elevation of an eyebrow.
Figure 13B:
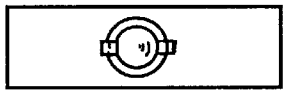
FIG. 13*b* is a top view of the eyebrow.
Figure 13C:
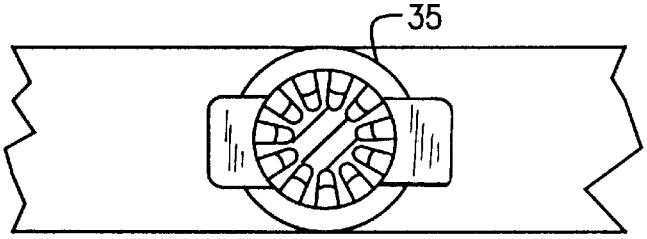
FIG. 13*c* is detailed top section of the eyebrow inserted in the collet and a cross section of an eyebrow shaft, showing grooves in the eyebrow shaft.

In a similar manner, as in FIG. 3, a shaft, 7 and 7', is perpendicularly affixed to the back side of each of the simulated eyebrows, 2 and 2', respectively, and are similarly inserted into the eye holes, 18 and 18', respectively, such that they can not easily be pulled out of the holes, but can rotate 60°. Stops 24 and 24', are is used to limit and lock rotation to 60°. FIGS. 13*a*–13*c* show alternative views of the simulative eyebrows. It should be noted that the dual tabs, 34 and 34', which extends in opposite directions from the shaft, 7, is limited in rotation to 60°, when inserted into the partially semicircular channels 27" and 28", respectively, as seen in FIG. 8. A circular collar, 35, surrounds the shaft at its base, as in FIG. 13*c*.

As seen in FIGS. 3 and 4, a clipping means, 21, is affixed to the rear of the shell, by a clip screw, 6, through hole 13. The clipping means is attached to an article of the user's clothing. The circular "eye" and "nose" areas, 15 and 15', and 16, respectively of the display button may be printed directly onto the shell, 1, in completing the presentation and the display of facial expressions.

In a typical embodiment of the clip means, 21, as shown in FIG. 3, a flat back piece, 5, and a flat front piece, 4, are rotatably affixed to each other, with both pieces being compressed toward each other by means of a compression spring, 25.

Figure 7:
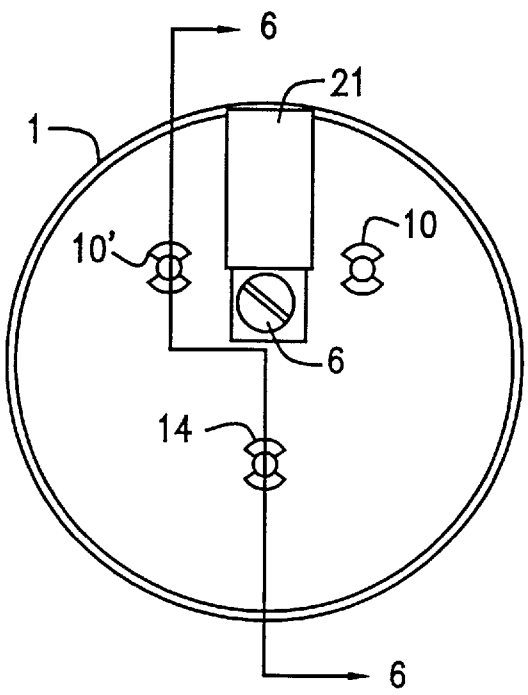
FIGS. 5, 6, and 7 are a front view, side cross-section, and rear view of the invention, respectively.
Figure 5:
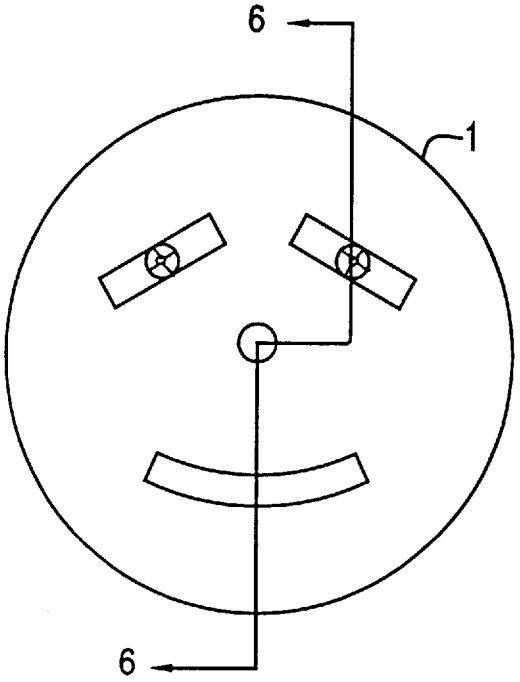

FIGS. 5, 6, and 7 show front, side, and rear views of the display button where the eyebrows and mouth can be rotated directly by hand by a wearer, either on lapel, pocket, or otherwise, by hand rotation. The views of FIGS. 5, 6, and 7 show a shell, 1, and a clip, 21, at the rear of the shell, used to secure the display to of an article of clothing. Also seen, is a screw, 6, for securing the clip, 21, to the shell, and inserted into a hole in boss, 11, or 12, depending on the desired position of the button on the wearer.

Figure 14:
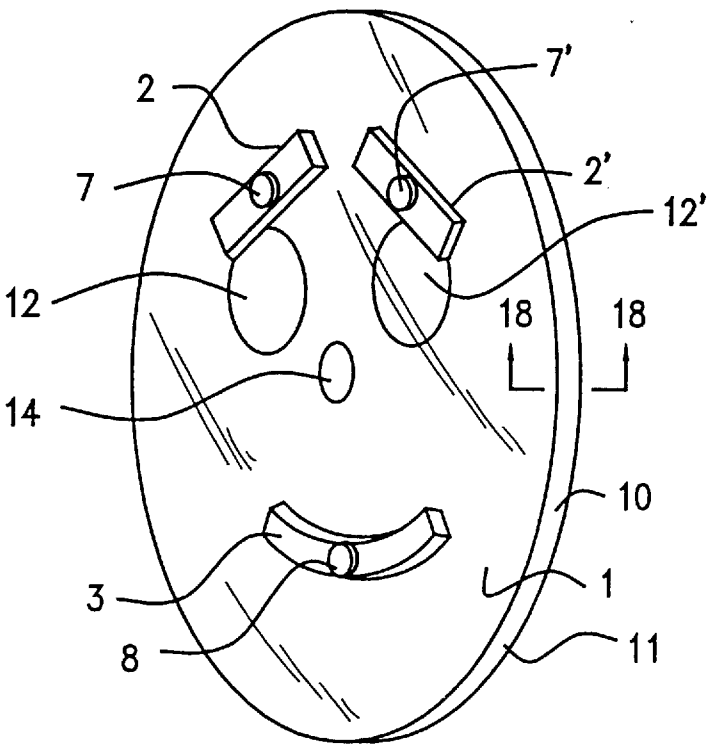
FIG. 14 is a front perspective view of the invention showing magnetic eyebrows and magnetic mouth.

As seen in FIG. 14, another embodiment of the invention employs magnets as the eyebrow members, 2 and 2', and as the mouth member, 3. Expansion fasteners, 7, 7', & 8, respectively pass through a central hole in the members.

Figure 15:
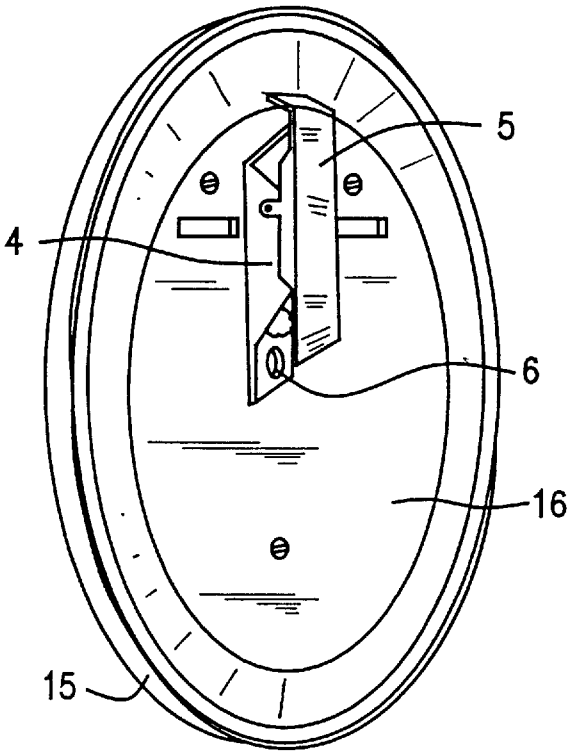
FIG. 15 is a rear perspective view of the invention as in FIG. 14.

A circular laminate consisting in sequence of a transparent front plate, 1; a second plate, 11, upon which is painted simulated eyes, 12 & 12', and a simulated nose, 14; and a ferrous metal plate, 10. As seen in FIG. 15, an end plate, 15, locks into the previous three plates. A means of affixing 5, the display to user is secured to the back, 16, of the end plate.

Figure 16:
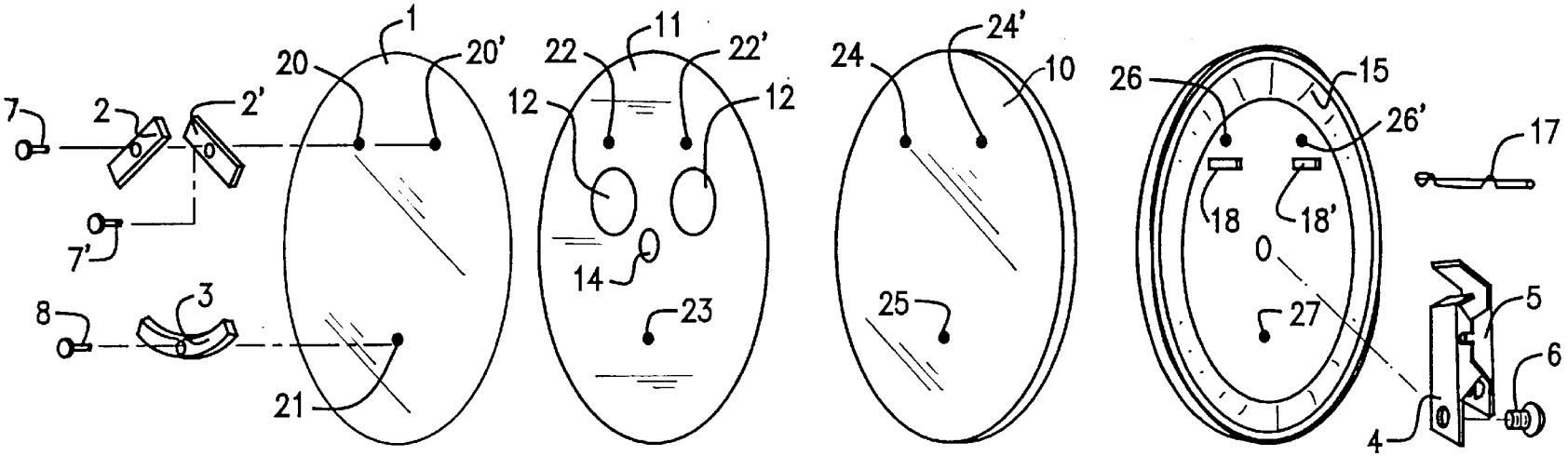
FIG. 16 is an exploded perspective view of the invention showing the magnetic eyebrows and magnetic mouth.

This embodiment of the invention is shown in an exploded view in FIG. 16. As can be seen, the expansion fasteners, 7, 7', & 8, pass through the members and through the four plates, 1, 11, 10, and 15, respectively. The members 2, 2', and 3, being magnetic are locked into place. When rotated by adhesion to the ferrous metallic plate, 10, they are secured axially by the expansion fasteners.

Figure 17:
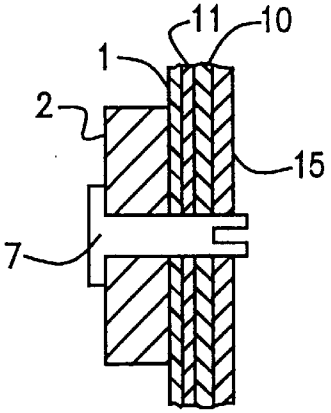
FIG. 17 is a cross section of the invention showing a magnetic eyebrows held in place.

FIG. 17 shows a detail view of the simulated eyebrows, 2 and 2', being held in placing by the expansion fasteners, which in turn pass through the laminate of the four circular plates.

Figure 18:
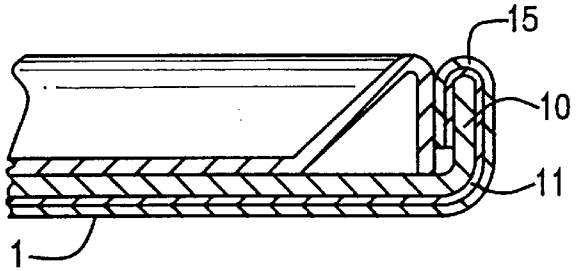
FIG. 18 is a cross section of the invention shown in FIG. 14.

FIG. 18, shows a detail of the four plates, illustrating the end plate, 15, being locked in place.

As seen in FIG. 16, the display may be secured to the user by a member of means, including a clip, 5, or a pin, 17.

What I claim is:

1. A display button worn by a person for showing human emotion expressions comprising:

a flat circular transparent front plate, having two small eye holes at the position of the eyes of a simulative human face and a small mouth hole at the position of the mouth of a simulative human face;

a flat circular second plate, being approximately the same diameter as the circular transparent front plate, having a front and back face, and having holes coinciding with the holes in the transparent front plate;

areas printed on the front face of the circular second plate to simulate the eyes and nose of a human face;

a flat circular metallic plate being the same diameter as the circular transparent front plate, having holes coinciding with the holes in the transparent front plate, composed of ferrous magnetic material and having a peripheral edge flange;

a flat circular end plate, being the same diameter as the circular magnetic plate, having holes coinciding with the holes in the transparent front plate and having locking means for affixing into the said circular metallic plate;

a pair of rectangular members composed of a magnetic material having a central hole, rotatably mounted through the plates at the eye holes;

a substantially arcuate member composed of a magnetic material having a central hole, rotatably mounted through the plates at the mouth hole;

a pair of expansion fasteners inserted through each of the two small eye holes in the front plate, said expansion fasteners expanding at the back of the end plate to hold the members in place;

a means of affixing the display to a person.

2. The display button in claim 1, wherein the human emotions shown are "happy", "confused", "sad", "skeptical", "scheming to get even", and "mad", alternatively, as the rectangular members and the arcuate member are rotated to alternate positions.

3. A display button worn by a person for showing human facial expressions comprising:

a substantially convex circular housing having a front substantially convex surface and a rear substantially concave surface;

a pair of rectangular members and an arcuate member, each having a front and back side rotatably mounted by shafts affixed perpendicularly to the said back sides, said shafts having longitudinal grooves, inserted through holes on said housing, said rectangular members to simulate the eyebrows at the position of the human eyebrows and said arcuate member to simulate a mouth at the position of a human mouth of a human face;

a pair of circular collars, with longitudinal internal grooves within said housing for adjustably rotating said rectangular members about first axes a first predetermined rotation;

a circular collar, with longitudinal internal grooves within said housing for adjustably rotating said arcuate member about a second axis a second predetermined rotation;

semicircular channels peripherally around the rectangular members shaft holes for locking said rectangular members at a first rotated position by means of radial tabs on the rectangular members shafts at the back side of the rectangular members;

a substantially semicircular channel peripherally around the arcuate shaft hole for locking said arcuate member at a second rotated position by means of radial tabs on the arcuate member shaft at the back side of the arcuate member;

hemispherical knobs on the rectangular members shafts for impeding the removal of the rectangular members;

a hemispherical knob on the arcuate member shaft for impeding removal of the arcuate member;

a means of affixing the display button to the wearer; and areas printed on the front surface of the housing to simulate the eyes and nose of a human face.

4. The display button in claim 3, wherein human emotions shown are "happy", "confused", "sad", "skeptical", "scheming to get even", and "mad", alternatively, as the rectangular members and the arcuate member are rotated to alternate positions.

5. The display button in claim 3, wherein the rectangular members shafts are cone shaped, with a larger end and a narrow end, with the larger end at the back side of the rectangular members, and the flat side of the hemispherical knobs are attached to the narrow end of the shafts, the pair of circular collars surrounding the larger end of the shafts.

6. The display button in claim 5, wherein the pair of circular collars each include a hollow split cone shaped collet projecting from the concave surface of the circular housing, said internal grooves coincident to the grooves in the rectangular members shafts, the hemispherical knobs being positioned beyond the smaller end of the collets, thereby keeping the rectangular members from being pulled.

7. The display button in claim 3, wherein the arcuate member shaft is cone shaped, with a larger end and a narrow end, with the larger end at the rear surface of the housing, and the flat side of the hemispherical knob is attached to the narrow end of the shaft, the circular collar surrounding the larger end of the shaft.

8. The display button in claim 7, wherein the circular collar includes a hollow split cone shaped collet projecting from the concave surface of the circular housing, said internal grooves coincident to the longitudinal grooves in the arcuate member shaft, the hemispherical knob being positioned beyond the smaller end of the collet, thereby keeping the arcuate member from being pulled.

* * * * *